US005189893A

United States Patent [19]

Kortenbrede

[11] Patent Number: 5,189,893

[45] Date of Patent: Mar. 2, 1993

[54] SHACKLE LOCK WITH A PIVOTABLE LOCKING ARRANGEMENT

[75] Inventor: Ludger Kortenbrede, Telgte, Fed. Rep. of Germany

[73] Assignee: Aug. Winkhaus GmbH & Co. KG, Telgte, Fed. Rep. of Germany

[21] Appl. No.: 719,801

[22] Filed: Jun. 24, 1991

[30] Foreign Application Priority Data

Sep. 17, 1990 [DE] Fed. Rep. of Germany .... 9013187.8
May 8, 1991 [EP] European Pat. Off. ..... 911075505

[51] Int. Cl.[5] ..... E05B 67/24

[52] U.S. Cl. ..... 70/38 A; 70/379 R; 70/380; 70/386

[58] Field of Search ..... 70/38 A, 39, 386, 38 R, 70/38 B, 38 C, 52, 379 R, 379 A, 380

[56] References Cited

U.S. PATENT DOCUMENTS

| | | | |
|---|---|---|---|
| 1,093,080 | 4/1914 | Shipman | 70/38 A |
| 1,461,725 | 7/1923 | Cooper | 70/39 |
| 1,679,665 | 8/1928 | Junkunc | 70/386 |
| 2,259,271 | 10/1941 | Seay, Jr. | 70/38 A |
| 3,713,309 | 1/1973 | Miller | 70/38 A |
| 3,848,440 | 11/1974 | Manuel | 70/55 |
| 4,112,715 | 9/1978 | Uyeda | 70/38 A |
| 4,158,952 | 6/1979 | Oliver et al. | 70/386 X |
| 4,763,496 | 8/1988 | Evans et al. | 70/38 A |
| 4,881,387 | 11/1989 | Kortenbrede | 70/39 |

FOREIGN PATENT DOCUMENTS

| | | |
|---|---|---|
| 8333943 | 3/1984 | Fed. Rep. of Germany . |
| 3400426 | 7/1984 | Fed. Rep. of Germany . |
| 3815584 | 8/1989 | Fed. Rep. of Germany . |
| 2103706 | 2/1983 | United Kingdom . |
| 2126648 | 3/1984 | United Kingdom . |
| 2142968 | 1/1985 | United Kingdom . |

*Primary Examiner*—Lloyd A. Gall
*Attorney, Agent, or Firm*—Anderson Kill Olick & Oshinsky

[57] ABSTRACT

A shackle lock, particularly with a long shackle, comprises a lock body and a lock shackle with two shackle arms, the free end portions of which are displaceable into a shackle arm housing of the lock body until they reach a locking position of the lock shackle. A lock mechanism is rotatable about an axis of rotation, particularly by a key. Disposed in the lock body is at least one locking element which meshes with the closure mechanism and which, upon actuation of the closure mechanism, is guided for movement out of a lock shackle arresting position in which the locking element is in engagement with the end portion of at least one shackle arm for locking the lock shackle and for movement into a lock shackle releasing position in which the locking element is out of arresting engagement with the end portion of the shackle arm. In this lock shackle releasing position the shackle arm can be withdrawn completely from the shackle arm housing. The locking element which is pivotally engaged with the closure mechanism can, upon actuation of the closure mechanism, be pivoted out of its lock shackle arresting position into the lock shackle releasing position and vice versa in a pivot plane which is virtually at right-angles to the axis of rotation of the closure mechanism.

15 Claims, 5 Drawing Sheets

SHACKLE LOCK WITH A PIVOTABLE LOCKING ARRANGEMENT

BACKGROUND OF THE INVENTION

The invention relates to a shackle lock, particularly with a long shackle, comprising a lock body, a lock shackle with two shackle arms the free end portions of which are displaceable into a shackle arm housing of the lock body until they reach a locking position of the lock shackle, a lock mechanism rotatable about an axis of rotation, particularly by means of a key and, disposed in the lock body at least one locking element which meshes with the closure mechanism and which, upon actuation of the closure mechanism, is guided for movement out of a lock shackle arresting position in which the locking element is in engagement with the end portion of at least one shackle arm for locking the lock shackle and into a lock shackle releasing position in which the locking element is out of arresting engagement with the end portion of the shackle arm so that the shackle arm can be withdrawn completely from the shackle arm housing.

STATEMENT OF PRIOR ART

Such a shackle lock is known from DE-PS 38 15 584, wherein on both sides of a plane of symmetry of the lock body containing the axis of rotation of the closure mechanism and the median longitudinal axes of the shackle arm housings and also on both sides of the closure mechanism there are two locking elements. The closure mechanism is in this case at its end opposite the key insertion end connected in rotationally rigid manner with a gear wheel the teeth of which engage racks. In each case one rack is rigidly connected to one locking element so that upon a rotation of the closure mechanism by the key this rotary movement leads via the gearwheel which is in engagement with the two racks to in each case a linear movement of the two locking elements. This per se very securely closing shackle lock becomes unfavourable when a particularly compact construction is required since it is necessary to provide on both sides of the closure mechanism sufficient space for the linear movement of the two locking elements.

Furthermore, there is already known from DE-OS 34 00 426 a shackle lock in which there are on both sides of the closure mechanism two spherical locking elements which engage corresponding recesses in the lock shackle. The cylindrical closure mechanism has at its end opposite the key insertion end two diametrically opposite flattened portions which extend parallel with the axis of rotation and which allow the two locking elements when they are in their lock shackle releasing position to move at least partially out of the shackle arm housings. In such a case, then, one of the two shackle arms can be extracted completely from the lock body, whereas the other shackle arm is still held fast in the lock body by the associated locking element. In order to be able to withdraw the shackle completely from the lock body, the closure mechanism has in addition to the two flattened portions also a recess which is via an edge directly adjacent one of the two flattened portions. If the closure mechanism, after reaching its position which corresponds to the lock shackle releasing position of the locking elements, is further rotated, then the locking element which retains the shackle arm which is as yet not completely withdrawn from the lock body, is able by virtue of the recess to move backwards sufficiently out of the shackle arm housing that the shackle arm can likewise be fully extracted -from the shackle arm housing. Where this shackle lock is concerned, it is a disadvantage that actuation of this shackle lock is relatively cumbersome since both flattened portions and also the recess are, via edges, adjacent the respective precedent surfaces Upon rotation of the closure mechanism, therefore, a marked resistance is always felt at the transition from one surface to the other.

A further shackle lock is known from the DE-GM 83 33 943.4, wherein a hardened pin is inserted into an end portion of a locking cylinder for abutting two ball-shaped locking members in opposite radial directions with respect to the locking cylinder, which ball-shaped locking members engage arms of the lock shackle when the lock shackle is in its locked position.

OBJECT OF THE INVENTION

The object of the present invention is to provide a shackle lock of the type mentioned at the outset and which is compact in construction while offering smooth and easy actuation.

SUMMARY OF THE INVENTION

A shackle lock, particularly with a long shackle, comprises a lock body and a lock shackle with two shackle arms, the free portions of which are displaceable into a shackle arm housing of the lock body until they reach a locking position of the lock shackle. A lock mechanism is rotatable about an axis of rotation, particularly by means of a key. Disposed in the lock body is at least one locking element which meshes with the closure mechanism and which, upon actuation of the closure mechanism, is guided for movement out of a lock shackle arresting position in which the locking element is in engagement with the end portion of at least one shackle arm for locking the lock shackle and for movement into a lock shackle releasing position in which the locking element is out of arresting engagement with the end portion of the shackle arm. In this lock shackle releasing position the shackle arm can be withdrawn completely from the shackle arm housing. The locking element which is in pivotal engagement with the closure mechanism can, upon actuation of the closure mechanism, be pivoted out of its lock shackle arresting position into the lock shackle releasing position and vice versa in a pivot plane which is virtually at right-angles to the axis of rotation of the closure mechanism.

Pivoting of the locking element permits of a very compact construction of the shackle lock since the space needed for a linear movement of the locking element is no longer required. Furthermore, as a result of the pivotal engagement between the closure mechanism and the locking element, a particularly smooth and easy actuation is possible.

A reliable and secure locking of the lock shackle together with the lock body is achieved in that there are in the lock body two locking elements which in the arresting position of the lock shackle engage with a respective end portion of the two shackle arms Consequently, each shackle arm is locked in the lock shackle arresting position in its shackle arm housing by its associated locking element.

In this respect, the two locking elements can for example be disposed in two mutually parallel planes which are at right-angles to the axis of rotation of the closure mechanism. It is equally possible for the two locking elements to be so disposed on both sides of the closure mechanism in the pivot plane which is at right-angles to the axis of rotation of the closure mechanism that they are not aligned with each other. A particularly simple and compact construction of shackle lock is achieved in that the two locking elements in the lock shackle arresting position are disposed in the lock body on both sides of the closure mechanism in the pivot plane and in a middle plane which is defined by the axis of rotation of the closure mechanism and by the median longitudinal axes of the shackle arm housings and in that their end close to the closure mechanism can be pivoted out of the median plane in order to obtain the lock shackle releasing position.

The shackle lock according to the invention can be provided for the most widely diverse uses. For example, it is conceivable to use it as a padlock. In this case, it is quite adequate for one of the two shackle arms to be withdrawable from its shackle arm housing so that it can for example be pushed through a retaining ring rigidly mounted on a door frame so that a shackle on a door, pushed onto the retaining ring, can be firmly secured. Then, the shackle arm can be pushed again into the shackle arm housing and locked there. However, if the shackle lock according to the invention is to be used on a two-wheeler, then it is advantageous for the shackle arms of the lock shackle which is preferably constructed as a long shackle, when in the lock shackle releasing position of the locking element, to be capable of being withdrawn completely from their shackle arm housings so that the lock shackle can be removed from the lock body. When completely separated from the lock body, the lock shackle can then be very easily pushed for instance onto some fixed object and onto a part of the two-wheeler which is rigid with the frame so that it can then be locked together with the lock body.

Particularly satisfactory operation of the shackle lock according to the invention is achieved in that the closure mechanism is rotated about an angle of between approx. 30° and approx. 50° and preferably approx. 45° between a lock shackle releasing position and a lock shackle arresting position. By virtue of this, after a very short pivoting movement, the lock shackle releasing position or lock shackle arresting position of the closure mechanism and of the locking element can be attained. Furthermore, it is possible to ascertain at a glance whether the closure mechanism is in its lock shackle releasing position or its lock shackle arresting position. Upon a pivoting of the locking element out of the lock shackle arresting position into the lock shackle releasing position and vice versa, the pivot angle traversed is between approx. 5° and approx. 20° and is preferably approx. 10°.

A particularly smooth and easy operation of the shackle lock according to the invention is achieved in that for pivotal engagement between the locking element and a rotatable member which is part of the closure mechanism and which is rotatable about the axis of rotation, the locking element or the rotatable body is provided with a spherical segment-like preferably hemispherical engagement surface and the rotatable body or the locking element is provided with a cup-shaped entraining surface the shape of which is adapted to the engagement surface.

The rotatable body can be constructed to be separable from the other parts of the closure mechanism and to be connected thereto by a rotary entraining connection The separate disposition of the rotatable body makes it possible for example to provide the entraining surface easily on the closure mechanism since the closure mechanism and the rotatable body can be manufactured separately and only joined at final assembly of the shackle lock.

The rotatable body may be of the most widely diverse shapes. If the rotatable body is constructed as a body of rotation, preferably spherical, in order thereby to center the rotatable body with respect to the lock body, then for the articulating connection between the locking element and the rotatable body, it is necessary for the cup-like entraining surface to be widened in the pivot plane. Viewed from the lock shackle releasing position, the widening out may extend in the direction of the lock shackle arresting position. Widening the cup-like entraining surface means that despite construction of the rotatable body as a body of rotation, there is nothing to hamper the pivoting movement of the locking element.

So that the shackle arm can be withdrawn from the shackle arm housing, the locking element must be able to move back completely out of the locking arm housing. According to the design of the pivotal engagement between the closure mechanism and the locking element, this can be achieved purely by a rotary movement of the closure mechanism. It is however also possible that, following a rotary movement of the closure mechanism, the locking element may still project into the shackle arm housing so that upon withdrawal of the lock shackle it is forced back by the end portion of the shackle arm. In such a case, for smooth operation, it is advantageous for the locking element, for engagement with the end portion of the shackle arm, to have a locking surface which is shaped like a segment of a sphere, being preferably hemispherical, and, in the lock shackle arresting position of the locking element, to engage a locking depression in the shackle arm the shape of which is adapted to match that of the locking surface.

In order to permit of a clearly defined pivoting movement, it is furthermore suggested that the pivoting movement of the locking element from the lock shackle releasing position into the lock shackle arresting position and vice versa be in each case defined by abutment surfaces in the shackle body.

The functional reliability of the shackle lock according to the invention can be furthermore improved in that the locking element is guided in the lock body by two guide faces which are parallel with the pivot plane of the locking element.

The compact construction of the shackle lock according to the invention is further enhanced in that the two guide faces and/or the two abutment faces are formed by the inner peripheral face of a locking element housing in the lock body which allows the pivoting movement of and accommodates the locking element.

When one shackle arm is withdrawn from the shackle arm housing, to prevent the locking element dropping into the shackle arm housing, it is furthermore envisaged that the portion of the locking element housing which opens out into the shackle arm housing tapers in the direction of the shackle arm housing in order to prevent the locking element dropping into the unoccupied shackle arm housing.

The locking element may be of quite different constructions. For example, it may consist of a rigid locking bolt. It is equally possible for the locking element to be constructed as a two-part locking bolt.

The locking bolt can thereby consist of a first locking bolt part and a second locking bolt part, the two locking bolt parts being displaceable in respect of each other, the first locking bolt part being in pivotal engagement to the closure mechanism while the second locking bolt part is provided for engagement with the end portion of the shackle arm. At its end which is remote from the closure mechanism, the first locking bolt part may have a recess which opens out and extends in the direction of the shackle arm housing and in which the second locking bolt part is displaceably disposed.

In order to achieve a stable position both in the lock shackle arresting position and also in the lock shackle releasing position, it may furthermore be envisaged that there should be between the first and second locking bolt parts a spring element, preferably a coil thrust spring, which biases the first locking bolt part in the direction of the closure mechanism and the second locking bolt part in the direction of the shackle arm housing.

The two locking bolt parts can in turn be of quite different construction. On the one hand, it is possible for the recess in the first locking bolt part to consist of a bore while the second locking bolt part is formed by a rod with a head and a shank, the shank of which is displaceably received in the bore in the first locking bolt part while its head is adapted to engage the end portion of the shackle arm, a possibly available spring element enclosing the shank and being biased against the head of the second locking bolt part and an edge of the bore of the first locking bolt part. It is however also possible for the recess in the first locking bolt part to consist of a bore and by a cup which in the direction of the shackle arm housing is adjacent the bore while the second locking bolt part consists of a ball, a possibly existing spring element being housed in the bore of the first locking bolt part and being biased on the bottom of the bore of the first locking bolt part and on the ball of the second locking bolt part.

In order to protect the closure mechanism from destruction in the event of an attempt to open the shackle lock by force, it is furthermore suggested that the closure mechanism be housed in a closure mechanism housing disposed rotationally rigidly in the lock body, the closure mechanism housing possibly extending at least partially out of the lock body, this protruding portion being additionally enclosed by an armour-plated housing.

Security against destruction of the closure mechanism and of the locking element can be further enhanced in that the lock body comprises a locking housing which accommodates the locking element and at least one shackle arm housing and an armour-plated housing which encloses the locking housing. The closure mechanism can be so disposed in the armour-plated housing that it is completely enclosed by this latter.

The locking housing may consist of two preferably identically shaped locking housing parts which, within the armour-plated housing, accommodate the closure mechanism between them, the closure mechanism being mounted on the locking housing parts and/or the armour-plated housing. Consequently, the shackle lock according to the invention is of virtually symmetrical construction, so simplifying its manufacture and assembly.

Both the locking housing and also the armour-plated housing may have a circular cross-section, the locking housing being rotationally rigidly disposed in the armour-plated housing. In consequence, it is possible for example to use standard components such as for example steel tubes, for producing the armour-plated housing.

The locking housing may be produced from die cast metal and/or the armour-plated housing may be produced from steel. This ensures a particularly thief-proof solid construction of the shackle lock according to the invention.

So that the object which is safeguarded by the shackle lock according to the invention is not scratched by the shackle lock and so that this latter is protected from corrosion, the lock body may be enclosed by a possibly multi-part synthetic plastics shell.

So that, despite the use of soft and easily workable and thus favourably priced materials for the closing mechanism, a stable and reliable locking of the lock shackle in its arrested position is guaranteed while wear and tear is at the same time reduced, it is furthermore proposed that the closure mechanism in the region of the pivotal engagement with the locking element have an insert part which is made from a material which is harder than the material of the closure mechanism in the region of the pivotal engagement and against which the locking element is braced when in the lock shackle arresting position.

The insert part may be formed by all manner of elements. For example, it is conceivable for the insert part to be a hardened leaf. An insert part which can be produced particularly easily and assembled may be obtained if it is formed by a rod housed in the end portion of the closure mechanism in a bore which extends in the pivot plane. The use of a rod for the insert part is also particularly advantageous if the shackle lock has two locking elements which in the pivot plane are disposed one on either side of the closure mechanism and engage the closure mechanism. The dimensioning of the rod will be governed by the anticipated loading.

The end faces of the rod may be straight. If the locking element is hemispherical in construction in the region of engagement with the closure mechanism, then it is advantageous for at least one of the end faces of the rod to be concave in construction. This ensures an all-over bearing of the locking element on the end face of the rod.

If the closure mechanism, in order to form the pivotal engagement between it and the locking element, is provided with a rotatable body, then this rotatable body may be provided with the preferably hardened rod which is rigidly inserted in a through bore in the rotatable body. The rotatable body can thereby be made from the most widely diverse materials. Preferably, a synthetic plastics material or galvanised die cast metal will be used for the rotatable body. By using a rotatable body for producing the pivotal engagement between the closure mechanism and the locking element in conjunction with the insert part, optimum materials may be selected for the relevant function.

The various features of novelty which characterize the invention are pointed out with particularity in the claims annexed to and forming part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

Further advantageous developments and examples of embodiment will be explained hereinafter with reference to the accompanying drawings, in which.

DETAILED DESCRIPTION OF THE PREFERRED EMBODIMENTS

Figure 1:
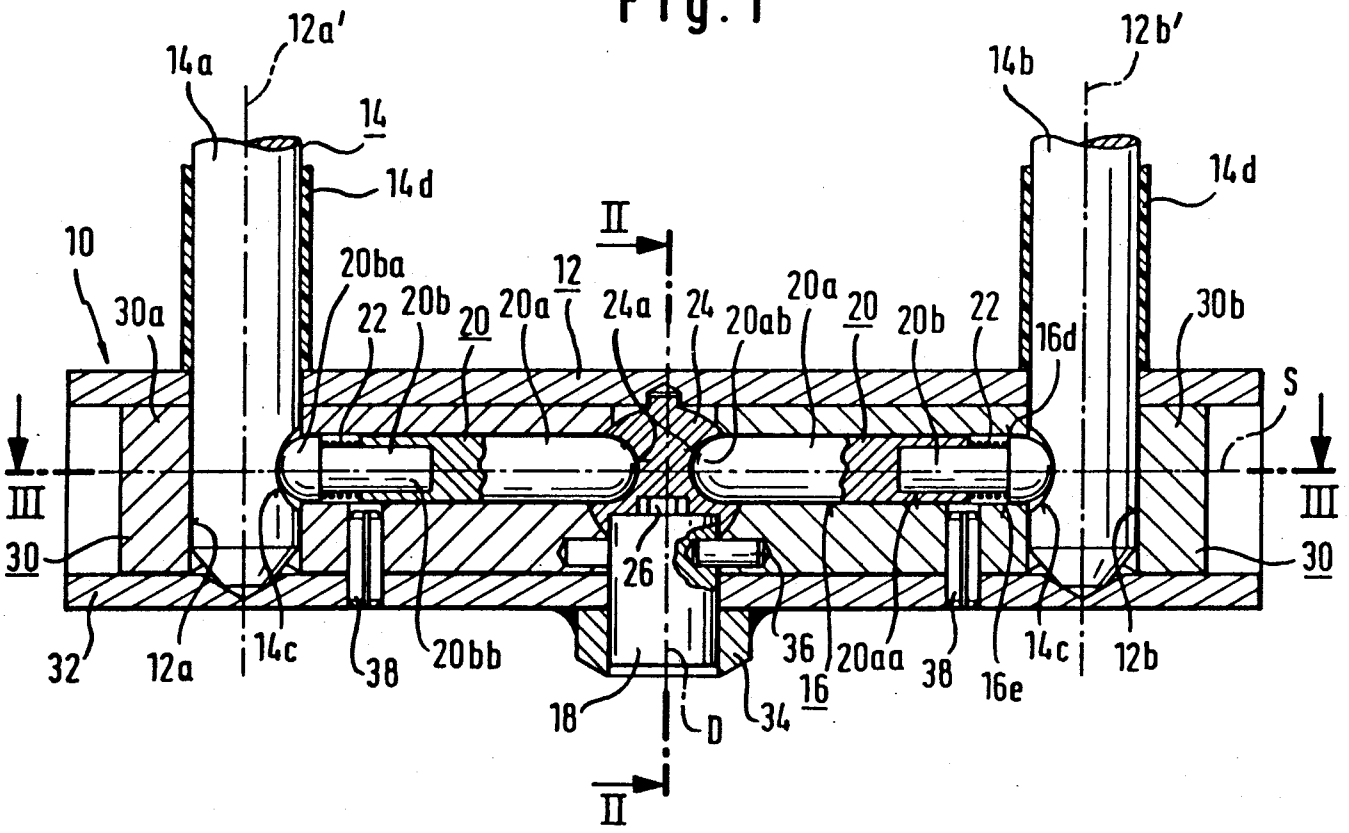
FIG. 1 shows a longitudinal section through a shackle lock according to the invention, with an only partially shown lock shackle.

FIG. 1 shows a first example of embodiment of shackle lock 10 according to the invention. This shackle lock 10 consists of a lock body 12 and an only partially illustrated lock shackle 14 with two shackle arms or channel engagement members 14*a*, 14*b* of which the free end portions are likewise designated 14*a*, 14*b*. The two end portions 14*a*, 14*b* of the lock shackle 14 are accommodated in respective shackle arm housings or channels 12*a*, 12*b* of the lock body 12. Furthermore, in the lock body 12 there are in respective locking element housings or cavities 16, disposed one on either side of a closure mechanism 18 having an axis of rotation D, two locking bolts or locking bar units 20 which form locking elements. The locking bolts or locking bar units 20 are so orientated that their respective longitudinal axes, in a lock shackle arresting position, lie in a main pivot plane S which is at right-angles to the axis of rotation D and in a median plane of the lock body 12, the median plane being defined by the axis of rotation D and the two median longitudinal axes 12*a*', 12*b*' of the shackle arm housings 12*a*, 12*b* and thus extending substantially at right-angles to the pivot plane S. The shackle arms 14*a*, 14*b* in the lock shackle arresting position of the locking bolts 20, are locked in the lock body 12 by respective locking bolts 20. The lock shackle arresting position corresponds thereby to a locking position of the lock shackle 14. In order to be able to withdraw the shackle arms 14*a*, 14*b* of the lock shackle 14 completely from the relevant shackle arm housings 12*a*, 12*b*, the two locking bolts 20 can be pivoted out of their lock shackle arresting position into a lock shackle releasing position by means of the key-operated closure mechanism 18 in a manner which is as yet to be described.

The two locking bolts 20 are identical in construction so that it is sufficient hereinafter to describe only one of the two in greater detail.

The locking bolt 20 consists of a first locking bolt part 20*a* and a second locking bolt part 20*b*. The locking bolt part 20*b* is formed by a rod 20*ba*, 20*bb* which consists of a head or locking end portion 20*ba* and a shank 20*bb*. The shank 20*bb* is housed by a bore 20*aa* which forms a recess in the first locking bolt part 20*a*. Between the first locking bolt part 20*a* and the second locking bolt part 20*b* there is, forming a spring element, a coil thrust spring 22 which is braced at one end on the head 20*ba* of the second locking bolt part 20*b* and at the other on the edge of the bore 20*aa* of the first locking bolt part 20*a*. The head 20*ba* of the second locking bolt part 20*b* has a hemispherical shape, the hemispherical surface forming a locking surface. In the lock shackle arresting position, the head 20*ba* projects into a locking depression 14*c* in the relevant shackle arm 12*a*, 12*b*.

The first locking bolt part 20*a* has at its end opposite the bore 20*aa* a hemispherical engagement surface or connected portion 20*ab* which engages a spherical rotatable body 24. The rotatable body 24 is connected by a rotary entraining connection in rotationally rigid manner to the closure mechanism 18 at 26. For engagement of the first locking bolt part 20*a*, the rotatable body 24 comprises cup-like entraining surfaces or concave pivot entraining faces 24*a*, the shape of which is adapted to the engaging surface 20*ab* of the first locking bolt part 20*a* (see also FIGS. 3*a*, 3*b*). Viewed from the lock shackle releasing position, the cup-like entraining surface 24*a* widens out in the direction of the lock shackle arresting position in the pivot plane S which is at right-angles to the axis of rotation D of the closure mechanism 18. This widening makes it possible upon a rotation of the closure mechanism 18 for the locking bolts 20 to be pivoted at the same time without hindrance.

Figure 3A:
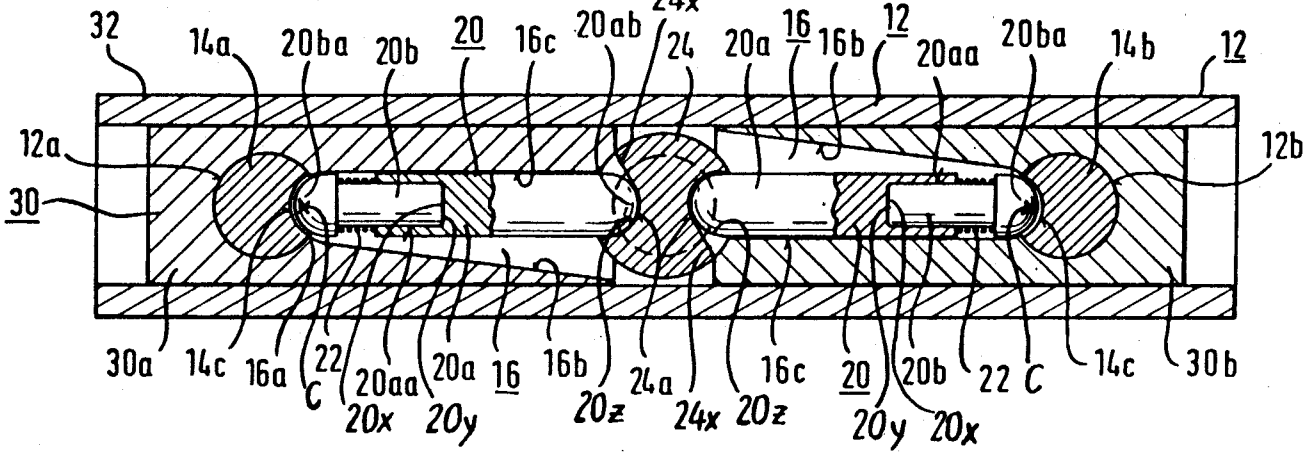
FIG. 3*a* shows a section taken on the line III—III in FIG. 1, the lock shackle being locked together with a lock body of the shackle lock.
Figure 3B:
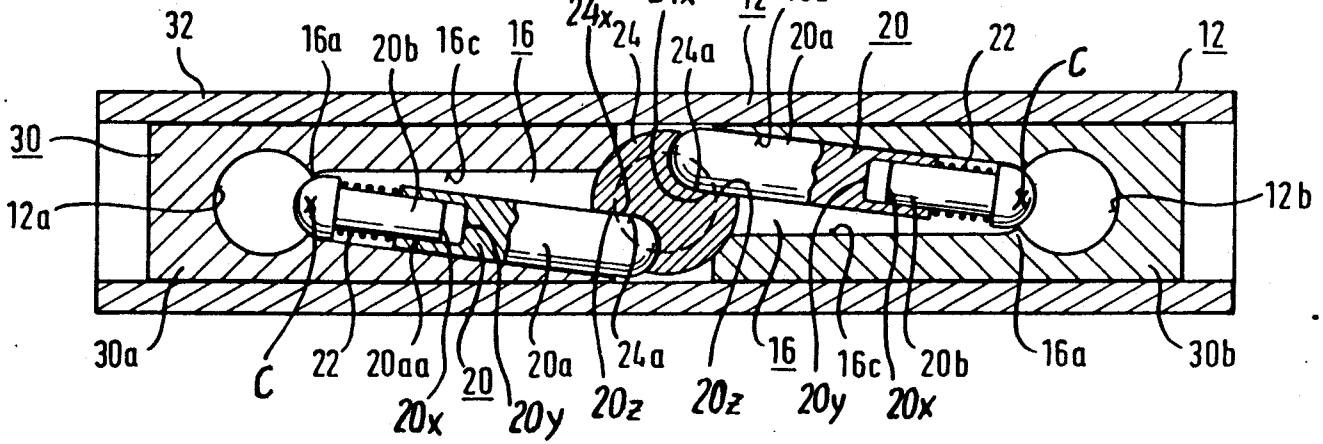
FIG. 3*b* shows a section taken on the line III—III in FIG. 1, the lock shackle being separate from the lock body.

As FIGS. 1 and 3*a*, 3*b* show, the two locking bolts 20 are disposed symmetrically in the lock body 12, i.e. they are disposed one on either side of the closure mechanism 18, on the one hand in the pivot plane S which is at right-angles to the axis of rotation D of the closure mechanism 18 and on the other in the median plane of the lock body 12. Upon a rotation of the closure mechanism 18, the two locking bolts 20 are pivoted in opposite directions.

For actuation of the shackle lock 10, firstly the key which is not shown in greater detail is inserted from below into the closure mechanism 18, see FIG. 1. Then, the closure mechanism 18 can be turned so that by virtue of the pivotal engagement between the first locking bolt parts 20*a* and the rotatable body 24, and by virtue of engagement of the hemispherical engagement surfaces 20*ab* of the first locking bolt parts 20*a* into the cup-like entraining surfaces 24*a* of the rotatable body 24, the two locking bolts 20 can be pivoted out of their lock shackle arresting position shown in FIG. 3*a* into the lock shackle releasing position shown in FIG. 3*b* about respective tilting centers C adjacent said shackle arm housings 12*a*, 12*b*. In the lock shackle releasing position, the first locking bolt parts 20*a* have their engagement surfaces 20*ab* so located in the cup-like entraining surfaces 24*a* of the rotatable body 24 that they fill the widened out part thereof. The two co-rotated second locking bolt parts 20*b* project thereby, due to the action of the coil thrust spring 22, into the locking depressions 14c in the two end portions 14a, 14b of the lock shackle 14. If thereupon the two end portions 14a, 14b of the lock shackle 14 are extracted from their relevant shackle arm housings 12a, 12b, then these end portions 14a, 14b displace the relevant second locking bolt parts 20b against the action of the coil thrust spring 22 out of the shackle arm housings 12a, 12b so that the two second locking bolt parts 20b move out of their arresting engagement with the two end portions 14a, 14b. The displacement of the relevant second locking bolt part 20b against the action of the coil thrust spring 22 is possible in the lock shackle releasing position because by virtue of the pivoting of the relevant locking bolt 20 as a whole the relevant second locking bolt part 20b can now be displaced in the bore 20aa, whereas in the lock shackle arresting position such a displacement path is not available due to respective length shortening restricting faces 20y, 20x of the first and second locking bolt parts 20a, 20 b coming into mutual engagement. Once the two second locking bolt parts 20b have been displaced out of the shackle arm housings 12a, 12b by the end portions 14a, 14b, the lock shackle 14 can be completely removed from the lock body 12. Then, in order to be able to withdraw the key, the closure mechanism 18 can be rotated again into the position shown in FIG. 3a either by actuation by means of the key or by a spring not shown in greater detail but provided in the closure mechanism 18. The keys can now be withdrawn.

In order to be able again to lock the lock shackle 14 with the lock body 12, it is necessary firstly to pivot the locking bolts 20 out of their lock shackle arresting position shown in FIG. 3a into the lock shackle releasing position shown in FIG. 3b, in so far as they are not already occupying this latter position by reason of a previous unlocking of the lock shackle 14, since the second locking bolt parts 20b do not allow the end portions 14a, 14b of the lock shackle 14 to enter the shackle arm housings 12a, 12b when in the lock shackle arresting position. When the locking bolts 20 have achieved their position shown in FIG. 3b, then the lock shackle 14 with its two end portions 14a, 14b can be inserted into the shackle arm housings 12a, 12b, the end portions 14a, 14b displacing the second locking bolt parts 20b from the shackle arm housings 12a, 12b against the action of the coil thrust spring 22. When the lock shackle 14 is again fully inserted into the lock body 12, then the two locking bolts 20 are pivoted back into their lock shackle arresting position shown in FIG. 3a either by actuation of the closure mechanism 18 by means of the key or by a spring not shown in greater detail but provided in the closure mechanism 18. Now the two second locking bolt parts 20b again engage the locking depressions 14c in the two end portions 14a, 14b of the lock shackle 14. As FIG. 3a shows, the respective second locking bolt part 20b cannot be displaced from the shackle arm housing 12a, 12b since the displacement path between the first locking bolt parts 20a and the second locking bolt parts 20b has been used up so that the lock shackle 14 is securely locked together with the lock body 12.

As likewise emerges from FIGS. 3a, 3b, the angle of rotation of the rotatable body 24 amounts to approx. 45°. The pivoting range of the two locking bolts 20 amounts thereby to approx. 10°, the pivoting movement being limited by abutment faces 16b, 16c disposed in the lock body 12 so that the relevant locking bolt 20 bears on one of the two abutment faces 16b, 16c in the lock shackle arresting position or lock shackle releasing position (see FIGS. 3a, 3b). By virtue of the unilateral widening out of the entraining surface 24a, thereby, the direction of rotation of the closure mechanism 18 which is in the lock shackle arresting position or the direction of pivoting of the locking bolts 20 is clearly established since the first locking bolt parts 20a, in the lock shackle arresting position, have their bolt member bearing on the abutment face 16c while their engagement surface 20ab is bearing on the non-widened out portion of the cup-shaped entraining surface 24a. The locking and the unlocking positions of the rotatable body 24 are defined by rotation limiting flanks 24x of the concave pivot entraining faces 24a engaging with side flanks 20z of the control end portions 20ab of the locking bolts 20. Furthermore, it can be seen from FIGS. 3a, 3b that, viewed from above in FIGS. 3a, 3b, the locking element housing 16 which is of substantially triangular shape tapers in its restricted outlet portion 16a to the respective shackle arm housing 12a, 12b in the direction of this latter, so that it is possible to prevent the second locking bolt parts 20b falling into the unoccupied shackle arm housings 12a, 12b.

The pivoting movement of the two locking bolts 20 is guided in the relevant locking element housing 16 by the guide surfaces 16d, 16e of the locking element housing 16 which extends parallel with the pivot plane S in FIG. 1 above and below the locking bolts 20. The guide surfaces 16d, 16e and the abutment faces 16b, 16c are thereby formed by the inner peripheral face of the locking element housing 16.

As emerges from FIG. 1, the two locking bolts 20 are accommodated in each case in a locking housing part 30a, 30b produced preferably from a die cast metal and which forms a locking housing 30. The two locking housing parts 30a, 30b are enclosed by a preferably common armour-plated housing 32 which is preferably manufactured from steel. Since on the one hand the shackle lock 10 according to the invention is intended to provide the most compact possible construction while on the other it is intended to use the closure mechanism 18 which is correspondingly long and which locks as reliably as possible, the closure mechanism 18 which is housed in a closure mechanism housing projects from the armour-plated housing 32 of the lock body 12. So that this projecting part of the closure mechanism 18 is safeguarded against unauthorised attempts to open it, it has, likewise assuming an armour-plating function, a further housing part 34 which is welded to the armour-plated housing 32 of the lock body 12. The closure mechanism 18 is rotationally rigid in the lock body 12 by means of a rod 36.

Figure 4B:
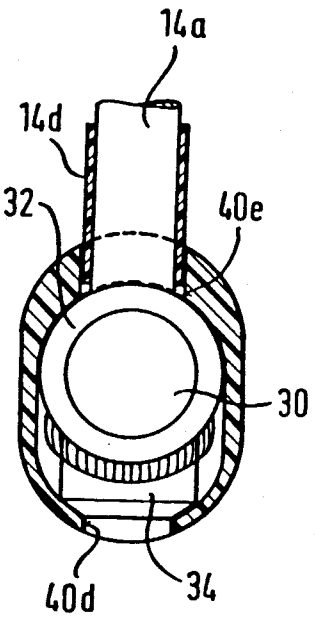
FIG. 4*b* shows a section taken on the line IV—IV in FIG. 4.
Figure 4:
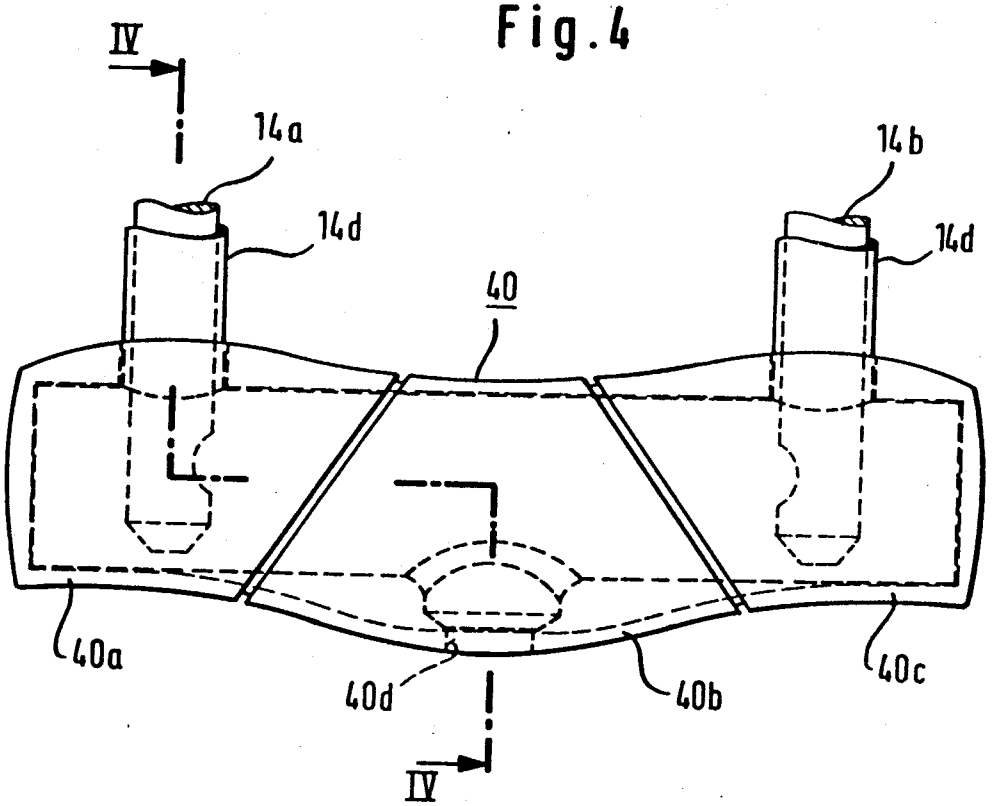
FIG. 4 shows a side view of the shackle lock housed in a synthetic plastics casing.
Figure 4A:
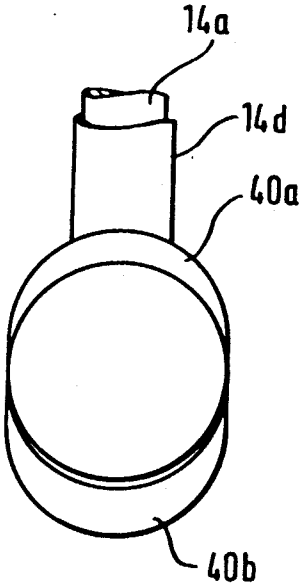
FIG. 4*a* is an end view of the shackle lock shown in FIG. 4.

In order to assemble the shackle lock 10 according to the invention, firstly the rod 36 is disposed in one of the two locking housing parts 30a, 30b. Then the two locking bolts 20 are pushed into their respective locking element housings 16, the two locking bolts 20 first being fitted together. For this, the coil thrust spring 22 is pushed onto the shank 20bb of the second locking bolt part 20b and then the second locking bolt part 20b together with the coil thrust spring 22 is pushed into the bore 20aa of the first locking bolt part 20a. Then the locking bolt 20 can be inserted into the locking element housing 16. Then the closure mechanism 18 is pushed into the armour-plated housing 32 of the lock body 12. Subsequently, the rotatable body 24 is introduced into the armour-plated housing 32 and is rotationally rigidly connected to the closure mechanism 18. Subsequently, the two locking housing parts 30*a*, 30*b*, in relation to FIG. 1, are inserted from left and right into the armour-plated housing 32, the rod 36 engaging a corresponding recess in the closure mechanism 18 while the two locking bolts 20 engage the two entraining surfaces 24*a* of the rotatable body 24. Then two clamping rods 38 are tapped in through the armour-plated housing 32 into respective locking housing parts 30*a*, 30*b*. Finally, the lock body 12 is enclosed in a synthetic plastics casing 40 which preferably consists of three parts 40*a–c* (see FIGS. 4, 4*a*, 4*b*). As FIG. 4 shows, the synthetic plastics casing 40 may be of undulating construction. As a result of the three-part nature of the synthetic plastics shell 40, it is possible for the individual parts 40*a–c* of the synthetic plastics casing 40 to be of different colours. As likewise emerges from FIG. 4, the synthetic plastics casing 40 is so constructed that it also masks that part of the closure mechanism 18 which projects from the armour-plated housing 32. For insertion of the key and of the two end portions 14*a*, 14*b* of the lock shackle 14, the synthetic plastics casing 40 comprises an aperture 40*d* and two apertures 40*e*. The lock shackle 14 can furthermore likewise be enclosed in a synthetic plastics tube 14*d*.

FIGS. 5 to 7*b* show a further embodiment of shackle lock according to the invention, the same components being identified by the same reference numerals, raised in each case by 100.

Figure 6:
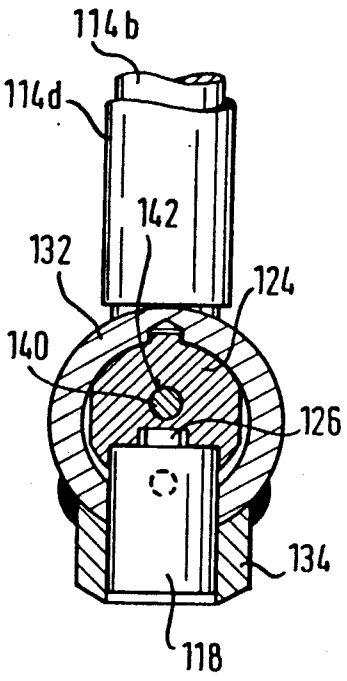
FIG. 6 shows a section taken on the line VI—VI in FIG. 5.
Figure 5:
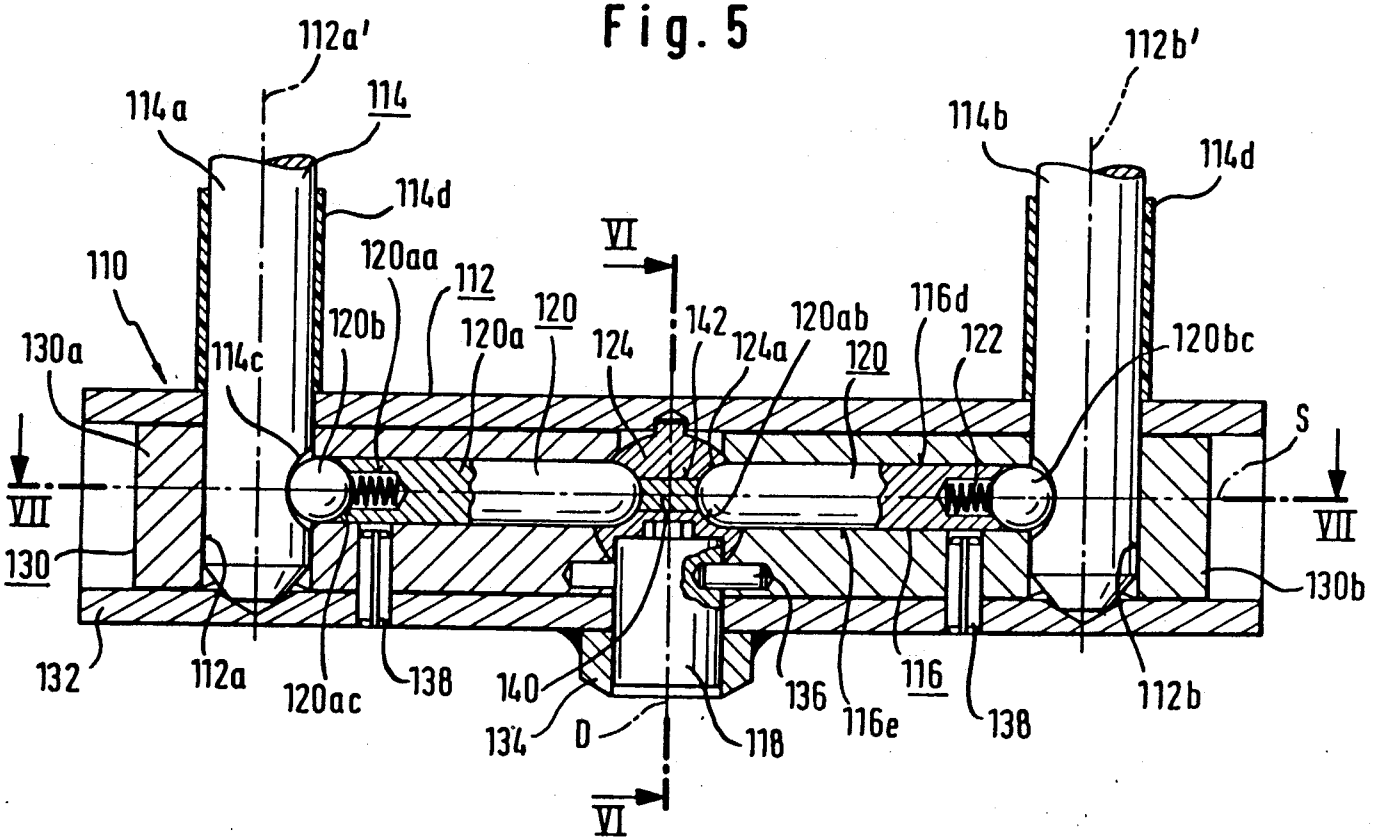
FIG. 5 shows a longitudinal section through a further example of embodiment of shackle lock according to the invention.
Figure 7A:
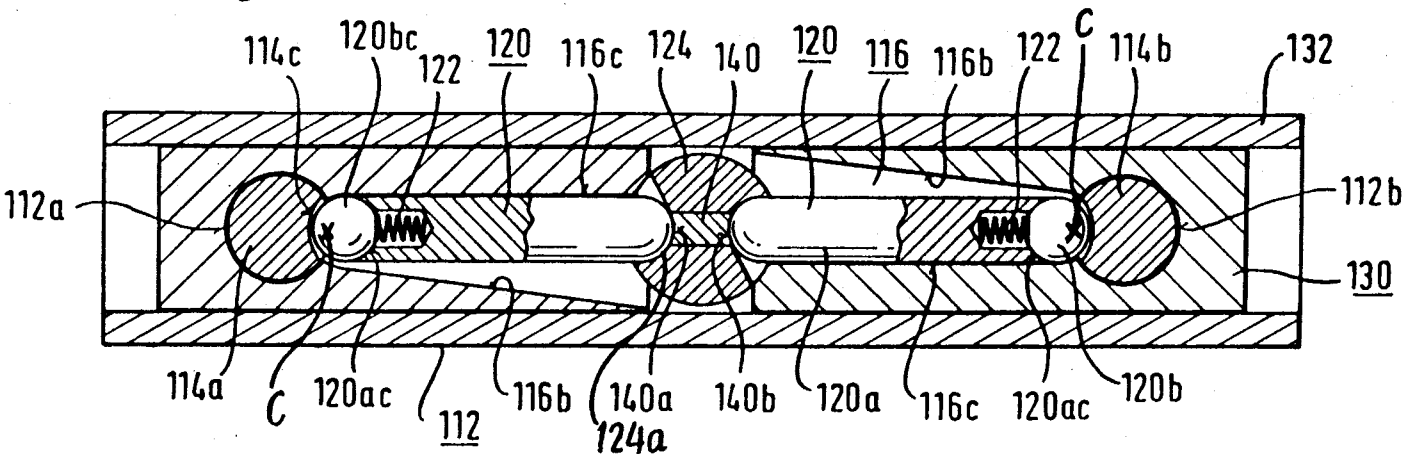
FIG. 7*a* shows a section taken on the line VII—VII in FIG. 5, a lock shackle being locked together with a lock body.
Figure 7B:
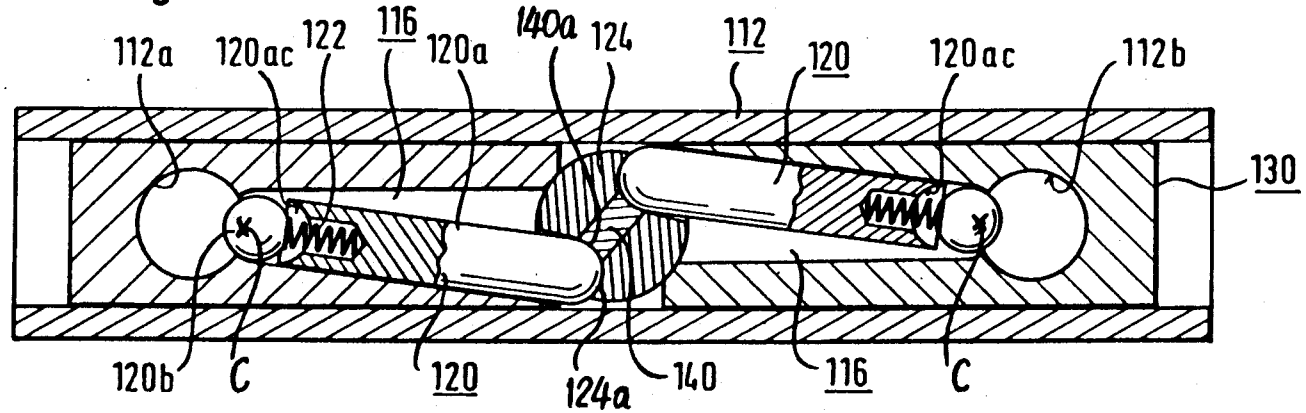
FIG. 7*b* shows a section taken on the line VII—VII in FIG. 5, the lock shackle being removed from the lock body.

The shackle lock 110 shown in FIGS. 5 to 7*b* differs from the shackle lock 10 shown in FIGS. 1 to 3*b* in that the second locking bolt part 120*b* of the locking bolts 120, instead of consisting of a rod, consists of a ball 120*bc* which is housed in a cup 120*ac* adjacent the bore 120*aa* of the first locking bolt part 120*a* (see FIGS. 7*a*, 7*b*). Furthermore, the shackle lock 110 differs from the shackle lock 10 shown in FIGS. 1 to 3*b* in that the rotatable body 124 is provided with a rod 140 which is disposed in a through bore 142 in the rotatable body. The axis of the bore 142 extends thereby in the pivot plane S. The rod 140 is produced from a hardened material and serves to brace the locking elements 120*a*, 120*b* in the lock shackle arresting position. The rotatable body 124 can be produced from galvanised die cast metal or synthetic plastics material. The end faces 140*a*, 140*b* are of concave construction (see FIG. 7*a*). The manner of functioning and all other structural details are otherwise concordant with the manner of functioning and the construction of the shackle lock 10 shown in FIGS. 1 to 3*b*.

Where both embodiments are concerned, the closure mechanism 18, 118 may comprise a closure cylinder which is disposed in a corresponding closure mechanism housing.

As is evident from the foregoing the shackle locks 10, 110 according to the invention are of symmetrical construction in relation to the axis of rotation D of the closure mechanism 18, 118 and the median plane containing the axis of rotation D and the median longitudinal axes 12*a*', 12*b*' of the shackle arm housings 12*a*, 12*b*. This greatly simplifies manufacture and assembly of the shackle locks 10, 110.

Figure 2:
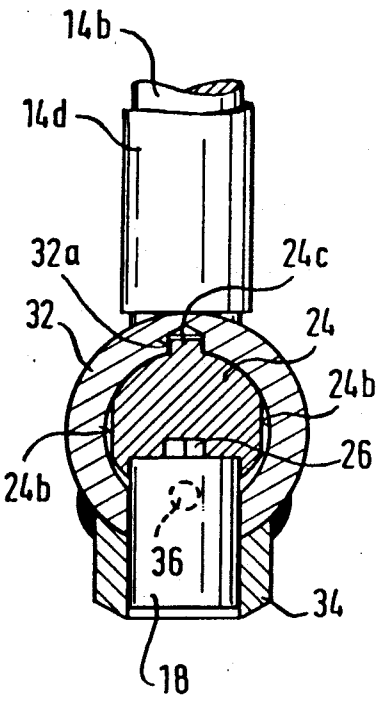
FIG. 2 shows a section taken on the line II—II in FIG. 1.

In conclusion, it should be pointed out that the spherical rotatable body 24 has, in order to save on material and for easier working, two flattened portions 24*b* and one pivot pin 24*c* by means of which the rotatable body 24 engages a corresponding recess 32*a* in the armour-plated housing 32 (see FIGS. 2, 6).

While specific embodiments of the invention have been shown and described in detail to illustrate the application of the inventive principles, it will be understood that the invention may be embodied otherwise without departing from such principles.

The reference numerals in the claims are only used for facilitating the understanding and are by no means restrictive.

I claim:

1. A lock unit comprising a lock body (12), said lock body (12) having a main plane (S) and at least one channel (12*a*, 12*b*) within said lock body (12), said at least one channel (12*a*, 12*b*) intersecting said main plane (S) and being adapted for accommodating a channel engagement member (14*a*, 14*b*), said channel engagement member (14*a*, 14*b*) having a locking depression (14*c*) substantially located in said main plane (S), when said channel engagement member (14*a*, 14*b*) is introduced into said channel (12*a*, 12*b*) to a predetermined depth, a rotatable body (24, 124) being rotatably mounted within said lock body (12) about an axis of rotation (D) substantially perpendicular to said main plane (S), said axis of rotation (D) being spaced from said channel (12*a*, 12*b*) along said main plane (S), a cavity (16) being provided within said lock body (12) substantially along said main plane (S) and extending from said rotatable body (24) to said channel (12*a*, 12*b*), an elongate locking bar unit (20, 120) within said cavity (16) extending from said rotatable body (24) to said channel (12*a*, 12*b*), said locking bar unit (20) having a locking end portion (20*ba*) adjacent to said channel (12*a*, 12*b*) and a control end portion (20*ab*) adjacent to said rotatable body (24), said locking end portion (20*ba*) being engageable with said locking depression (14*c*) of said channel engagement member (14*a*, 14*b*) when said channel engagement member (14*a*, 14*b*) is introduced into said channel (12*a*, 12*b*) to said predetermined depth, said control end portion (20*ab*) having a convex pivot end face pivotally engaged with a concave pivot entraining face (24*a*, 124*a*) of said rotatable body (24), said elongate locking bar unit (20) being, in response to rotation of said rotatable body (24) about said axis of rotation (D), tiltable within said cavity (16) in parallel with said main plane (S) about a tilting center (C) adjacent said channel (12*a*, 12*b*) between a locking tilt position substantially parallel to a connection line extending in said main plane (S) from said tilting center (C) to said axis of rotation (D) and an unlocking tilt position tilted with respect to said connection line, the distance between said locking depression (14*c*) and said concave pivot entraining face (24*a*) being shorter in said locking tilt position than in said unlocking tilt position, said locking bar unit (20) having an effective length variable against the action of internal prestress means (22), said locking bar unit (20) extending both in said locking tilt position and in said unlocking tilt position in a straight direction from a location of contact of said locking end portion (20*ba*) with said locking depression (14*c*) to a location of contact of said control end portion (20*ab*) with said concave pivot entraining face (24*a*), said rotatable body (24) being lockable against rotation in a locking position corresponding to said locking tilt position of said locking bar unit (20), said locking end portion (20*ba*) being prevented from completely falling into said channel (12*a*, 12*b*) under the action of the prestress means (22) by a restricted outlet portion (16*a*) of said cavity (16) towards said channel (12*a*, 12*b*), said restricted outlet portion (16*a*) permitting, however, engagement of said locking end portion (20*ba*) with said locking depression (14*c*).

2. A lock unit as set forth in claim 1, wherein said locking bar unit (20) is limited against tilting movement beyond said locking tilt position and said unlocking tilt position by respective abutment faces (16*c*, 16*b*) of said cavity.

3. A lock unit as set forth in claim 1, wherein a minimum value of said effective length of said locking bar unit (20) is defined by length shortening restricting means (20*x*, 20*y*) of said locking bar unit (20), said length shortening restricting means (20*x*, 20*y*) preventing disengagement of said locking end portion from said locking depression (14*c*) in said locking tilt position.

4. A lock unit as set forth in claim 1, wherein said rotatable body (24) is rotatable through an angle of rotation of about 45° between a locking position corresponding to said locking tilt position and an unlocking position corresponding to said unlocking tilt position, the angular distance between said locking tilt position and said unlocking tilt position of said locking bar unit (20) being about 10°.

5. A lock unit as set forth in claim 1, wherein a locking position of said rotatable body (24) corresponding to said locking tilt position, and an unlocking position of said rotatable body (24) corresponding to said unlocking tilt position is defined by a rotation limiting flank (24*x*) of said concave pivot entraining face (24*a*) of said rotatable body (24) engageable with a side flank (20*z*) of said control end portion (20*ab*).

6. A lock unit as set forth in claim 1, wherein said rotatable body (124) is shaped of a first material, said concave pivot entraining face (124*a*) being partially shaped in a body (140) of a second material inserted into said rotatable body (124), said second material being harder than said first material.

7. A lock unit as set forth in claim 1, wherein said locking bar unit (20) comprises two telescopically engaged locking bolt parts (20*a*, 20*b*).

8. A lock unit as set forth in claim 1, wherein said locking bar unit (120) comprises a bolt part (120*a*) and a ball part (120*b*) accommodated by a cup face (120*ac*) of said bolt part (120*a*), said ball part (120*b*) acting as said locking end portion.

9. A lock unit as set forth in claim 1, wherein said lock body (12) has two substantially parallel channels (12*a*, 12*b*) for accommodating two respective channel engagement members (14*a*, 14*b*), said rotatable body (24) being located in said lock body (12) substantially midway between said channels (12*a*, 12*b*), two respective locking bar units (20) extending between said rotatable body (24) and each of said channels (12*a*, 12*b*), respectively.

10. A lock unit as set forth in claim 9, wherein said channel engagement members (14*a*, 14*b*) are end portions of a lock shackle (14).

11. A lock unit as set forth in claim 1, wherein said channel (12*a*, 12*b*) has a channel axis (12*a*', 12*b*') substantially perpendicular to said main plane (S).

12. A lock unit as set forth in claim 1, wherein said lock body (12) is covered by a synthetic plastic casting (40).

13. A lock unit as set forth in claim 1, wherein said rotatable body (24) is substantially ball-shaped.

14. A lock unit as set forth in claim 9, wherein said lock body (12) comprises a housing (32) and, positioned within said housing (32), two separate body parts (30*a*, 30*b*), each of said body parts (30*a*, 30*b*) comprising a respective channel (12*a*, 12*b*) and a respective cavity (16), said rotatable body (24) being located between mutually adjacent ends of said body parts (30*a*, 30*b*) within said housing (32).

15. A lock unit as set forth in claim 14, wherein said housing (32) is made of steel.

* * * * *